US009884738B1

(12) United States Patent
Arce

(10) Patent No.: US 9,884,738 B1
(45) Date of Patent: Feb. 6, 2018

(54) WIRE CADDY

(71) Applicant: Carlos Arce, Costa Mesa, CA (US)

(72) Inventor: Carlos Arce, Costa Mesa, CA (US)

( * ) Notice: Subject to any disclaimer, the term of this patent is extended or adjusted under 35 U.S.C. 154(b) by 0 days.

(21) Appl. No.: 15/476,779

(22) Filed: Mar. 31, 2017

Related U.S. Application Data

(60) Provisional application No. 62/370,713, filed on Aug. 4, 2016.

(51) Int. Cl.

| | |
|---|---|
| ***B65H 49/32*** | (2006.01) |
| ***B65H 75/40*** | (2006.01) |
| ***B65H 75/44*** | (2006.01) |
| ***B65H 75/14*** | (2006.01) |

(52) U.S. Cl.
CPC ..... *B65H 49/322* (2013.01); *B65H 49/325* (2013.01); *B65H 75/14* (2013.01); *B65H 75/40* (2013.01); *B65H 75/4402* (2013.01); *B65H 2701/36* (2013.01)

(58) Field of Classification Search
CPC .. B65H 49/322; B65H 49/324; B65H 49/325; B65H 75/14; B65H 75/40; B65H 75/4402
See application file for complete search history.

(56) References Cited

U.S. PATENT DOCUMENTS

| | | | | |
|---|---|---|---|---|
| 5,267,705 | A * | 12/1993 | Hofrichter | B65H 49/24 242/129 |
| 6,145,780 | A * | 11/2000 | Fontana | B65H 49/24 242/400 |
| 6,375,115 | B1 * | 4/2002 | Reed | B25H 3/02 206/389 |
| 2007/0120003 | A1 * | 5/2007 | Grant | B65H 49/24 242/557 |
| 2010/0163667 | A1 * | 7/2010 | Dorais | B65H 49/322 242/587 |
| 2013/0087652 | A1 * | 4/2013 | Chastain | B65H 49/322 242/588.3 |

* cited by examiner

*Primary Examiner* — William E Dondero
(74) *Attorney, Agent, or Firm* — George P. White

(57) ABSTRACT

A toolbox-size device contains wire spools that are supported by both a cradle and a removable axial spindle. This dual support contributes to solving several problems involved with manual wire deployment devices. Particular object spatial and size relationships can include those of the cradle, spindle, spool diameter, spool hub, arbor-opening diameter, enclosure size, and exit aperture location. This provides a solution to reliably and smoothly deploy electrical wire manually from a hand-carried device. The cradle holds spools generally in place when the axial spindle is removed to add or remove spools. The dual support system allows the use of spools with damaged flanges normally not possible with a cradle-based system.

3 Claims, 11 Drawing Sheets

(1) Flange Diameter
(2) Traverse
(3) Barrel Outer Diameter
(4) Arbor Hole

| SPOOL SIZE | (1) Flange Diameter | (2) Traverse | (3) Barrel Outer Diameter | (4) Arbor Hole | Color |
|---|---|---|---|---|---|
| A | 2 1/8" | 5/8" | 1 1/8" | 1" | White |
| B | 2 1/8" | 1 1/8" | 1 1/8" | 1" | White |
| C | 2 1/8" | 2 1/8" | 1 1/8" | 1" | White |
| D | 2 7/8" | 2 1/8" | 1 1/8" | 1" | White |
| E | 5" | 2" | 1 7/8" | 0.78" | Black |
| F | 5" | 4" | 1 7/8" | 0.78" | Black |
| G | 6 ½" | 2 ½" | 2" | 0.78" | Black |
| H | 6 ½" | 4 ½" | 2" | 0.78" | Black |
| I | 6 ½" | 6" | 2" | 0.78" | Black |
| J | 6 ½" | 8" | 2" | 0.78" | Black |
| K | 10" | 8" | 3 ½" | 0.78" | Black |
| L | 10" | 10" | 3 ½" | 0.78" | Black |
| M | 4 ½" | 3 ½" | 3" | 0.75" | Black |

WIRE CADDY

This disclosure relates to portable coiled wire support for manual transportation and deployment of spooled wire. This application claims the benefit of provisional application 62/370,713 filed on Aug. 4, 2016, which is hereby incorporated by reference in its entirety.

FIELD

Background

Cords, threads, wire, fishing line, and similar flexible linear materials have been stored on, and deployed from, spools for millennia. For example there are over ten thousand U.S. patents related to fishing reels alone. Nonetheless, improvements in spools and related to using spools remain a fertile technology area due to the many materials spooled and the many uses of spooled material.

While there are many devices for supporting spooled wire for manual deployment by electricians, persistent difficulties with tangling, jamming, over-run, and other issues remain.

SUMMARY

A toolbox-size device contains wire spools that are supported by both a cradle and a removable axial spindle. This dual support contributes to solving several problems involved with manual wire deployment devices. Particular object spatial and size relationships can include of the cradle, spindle, spool diameter, spool hub, arbor opening diameter, enclosure size, and exit aperture location; provide a solution to reliably and smoothly deploy electrical wire manually from a hand-carried device. The cradle holds spools generally in place when the axial spindle is removed to add or remove spools. The dual support system allows the use of spools with damaged flanges normally not possible with a cradle-based system.

DETAILED DESCRIPTION

Structure

Figure 1:
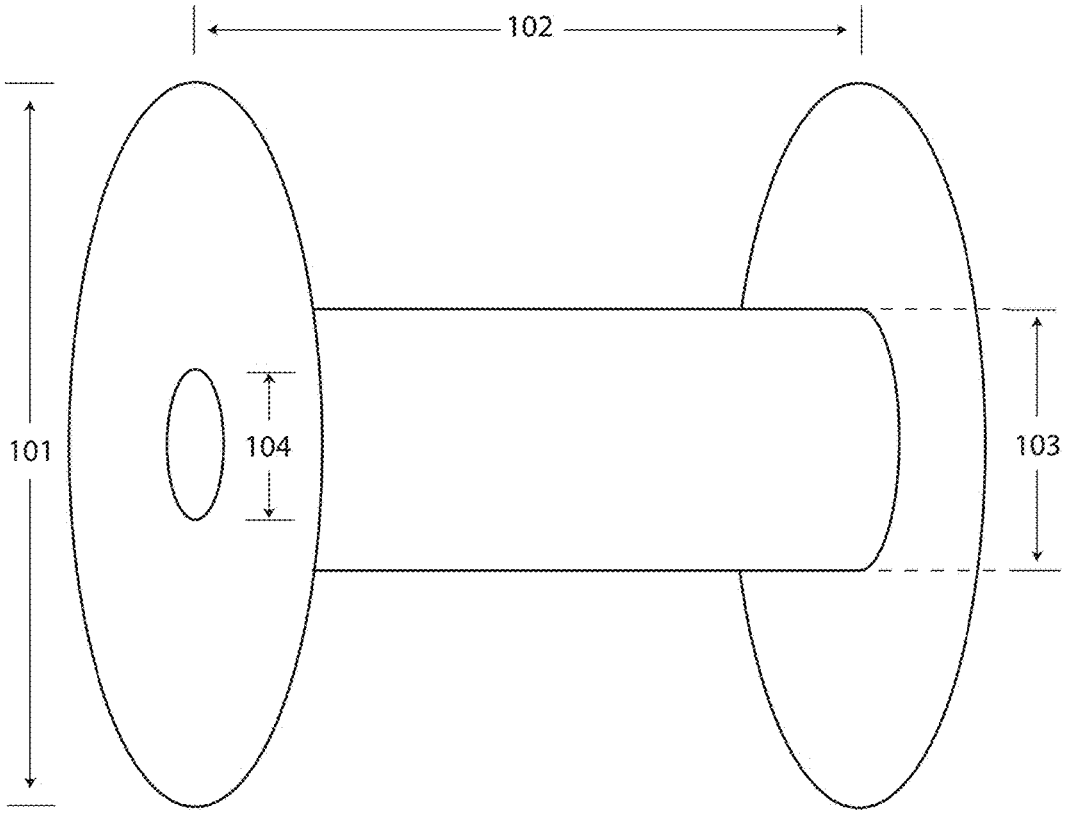
FIG. 1 is a schematic drawing of a wire spool.
Figure 2:
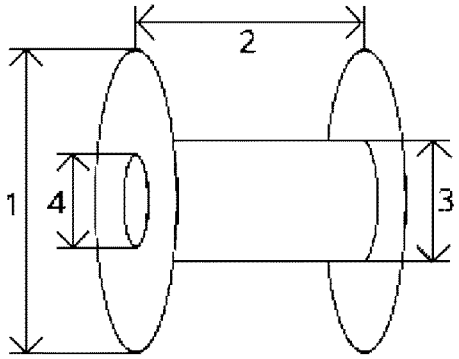
FIG. 2 is a table showing industry standard sizes for the spools of FIG. 1.

While these teachings apply to a wide range of spools of various dimensions, the example and discussion is based on spools of a type widely used in the wire and cable industries for AWG wire gauges of 14, 12 and 10 gauge. FIG. 1 shows a schematic drawing of a wire and cable industry standard wire spool. The various structures and distances usually specified include flange diameter 101, traverse 102, barrel outer diameter 103, and arbor hole size 104. FIG. 2 shows a table of nominal standard sizes.

Figure 3:
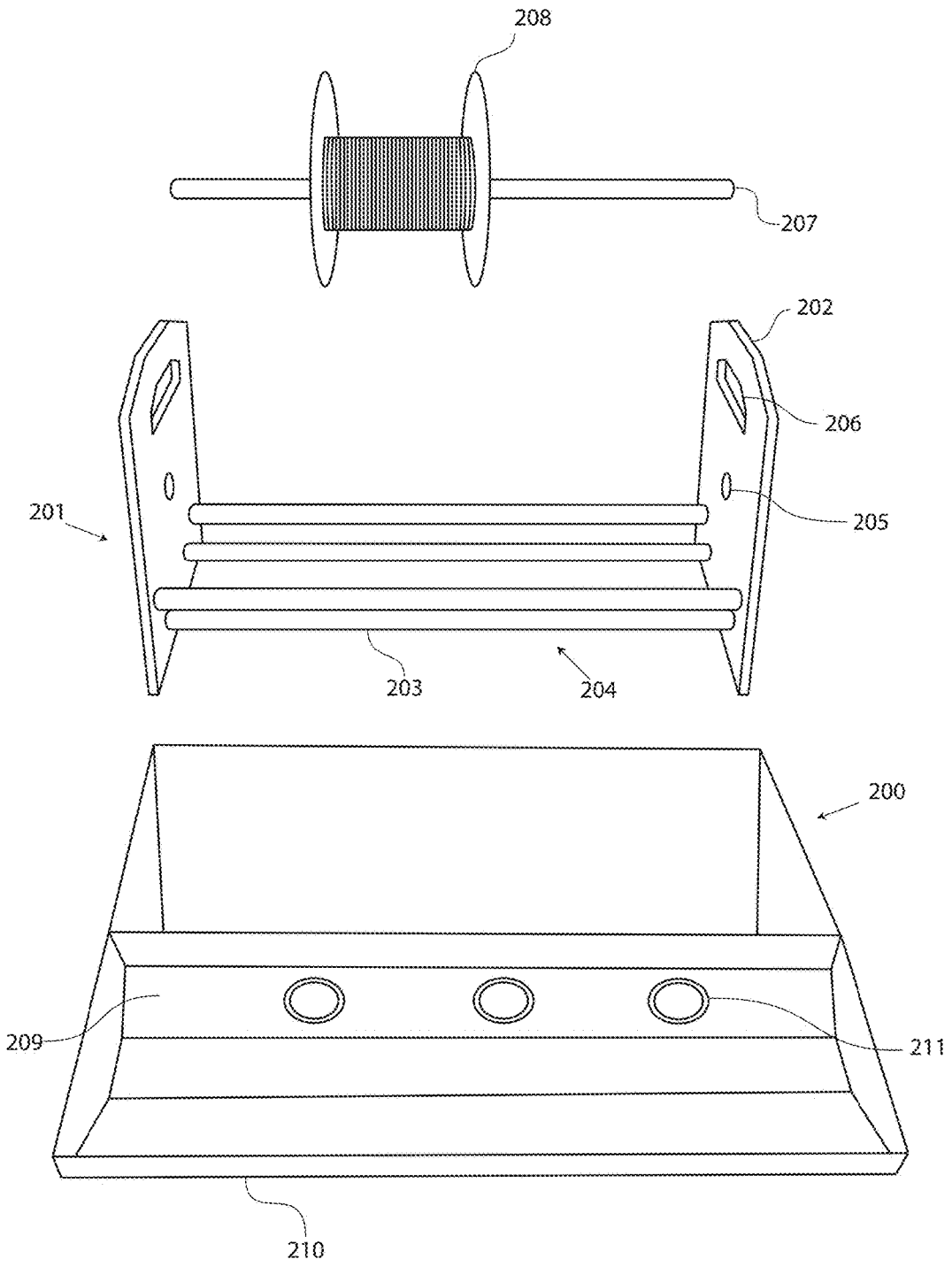
FIG. 3 shows an exploded view of an embodiment wire caddy.

An example embodiment wire caddy is shown in an exploded state in FIG. 3. Although not drawn to a specific scale the relative sizes of components are accurate. The depicted version is sized to hold up to three 6½" diameter spools. An enclosure 200 of a similar size and shape as a toolbox holds a spool support 201. The spool support has two opposing flat end plates 202 joined by rods 203 that make up a cradle 204. In addition, the end plates have openings to accept a spindle that extends axially through the spool or spools 205. The spindle 207 radiuses in this example are about 80%-90% of that of the arbor opening. In this example, the cradle rods are rollers.

Figure 4:
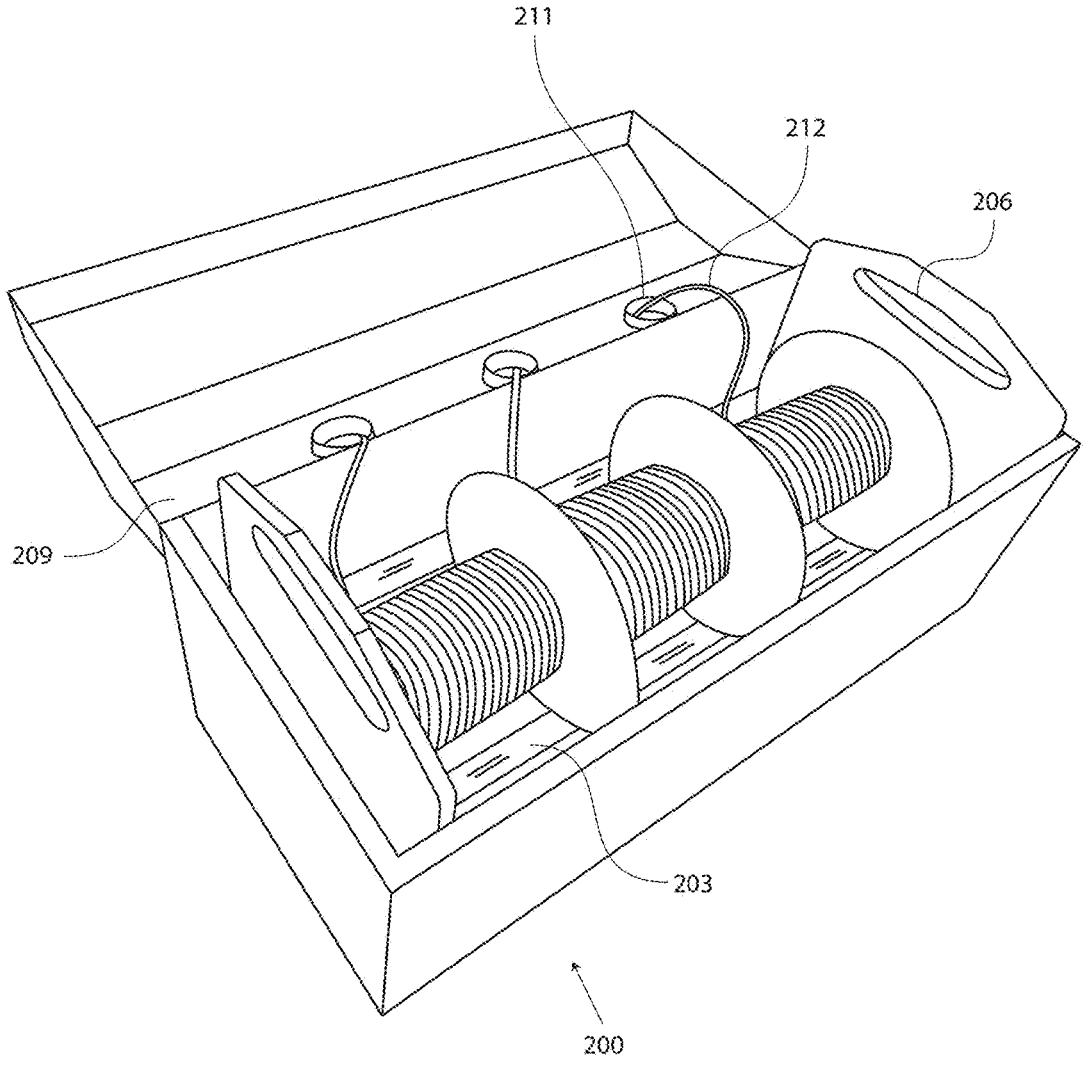
FIG. 4 shows three spools loaded into the embodiment of FIG. 3.
Figure 5:
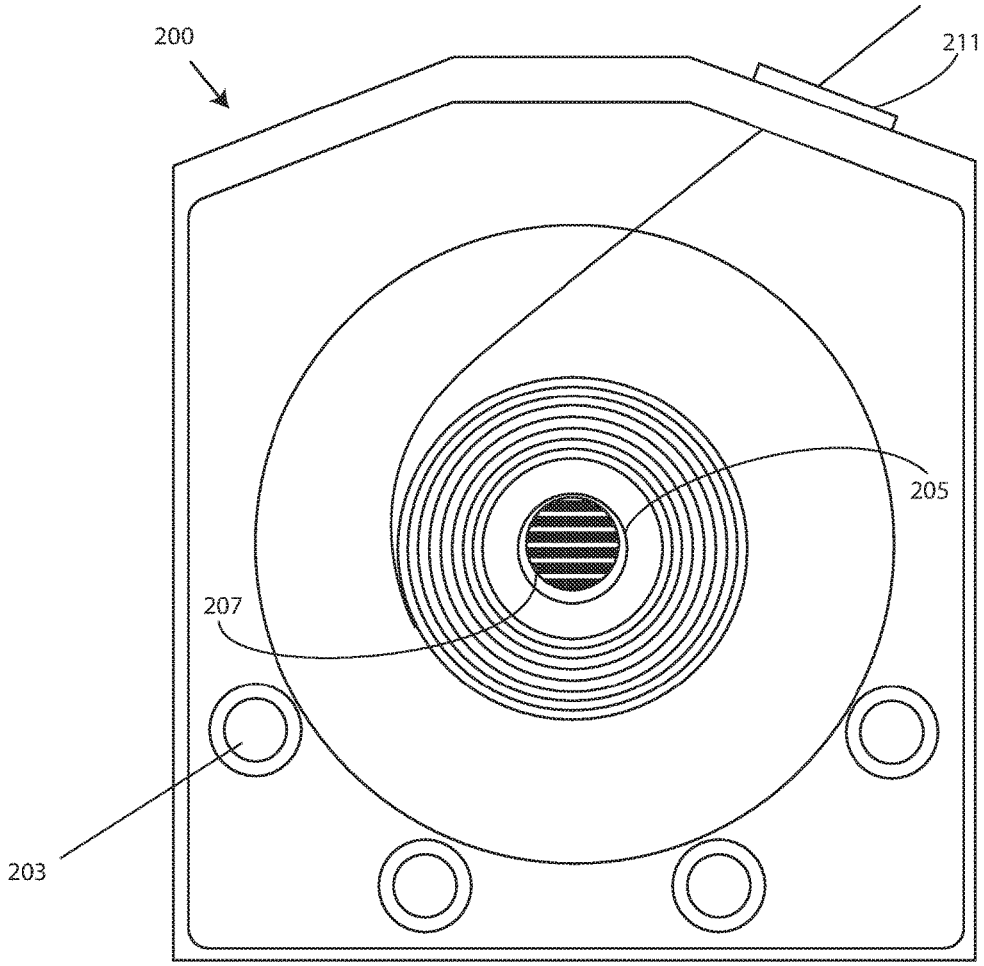
FIG. 5 shows a schematic cut away view of a spool accommodated in the embodiment of FIG. 1.

The spool support fits loosely the enclosure as seen in FIG. 4 and is readily removable from the enclosure. The portrayed example shows handhold cutouts 206 for this purpose. The end of the wire 212 of each spool is shown threaded through respective exit apertures 211. FIG. 5 shows a schematic form of a cutaway view with the lid closed and wire exiting through an aperture located on an angled portion of the lid, near one edge.

Figure 6A:
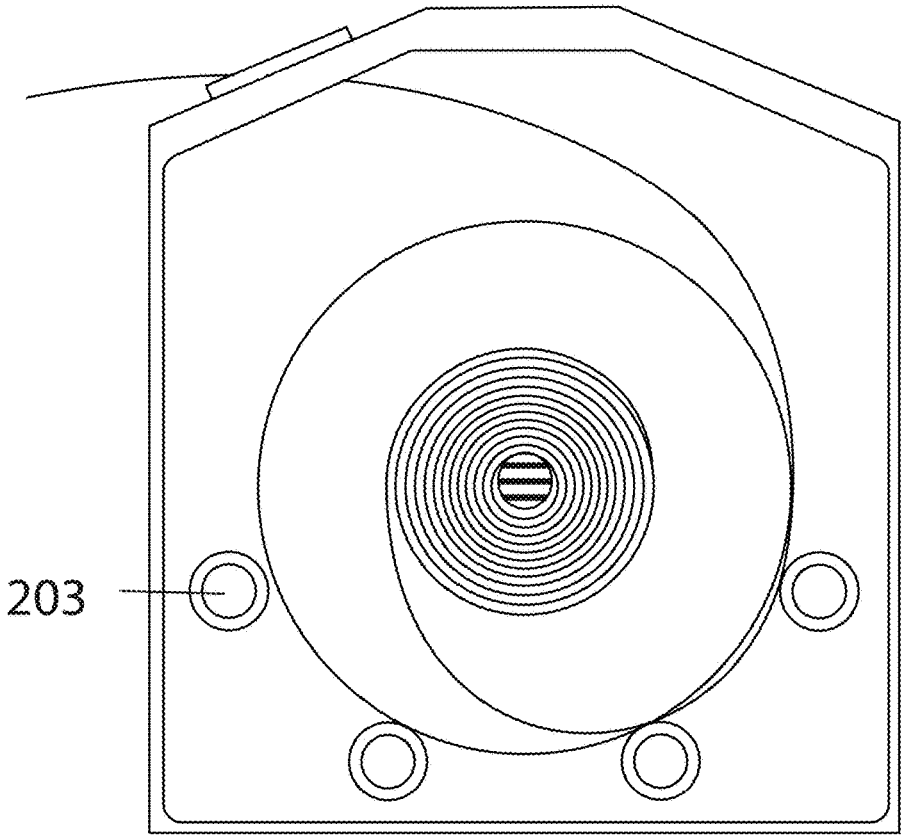
FIG. 6A shows the position of a spooled wire after a recoil.

Many existing spool caddies have axial spindles; one example is seen in FIG. 6 of U.S. Pat. No. 6,375,115 showing a device providing axial support. Some others have arcuate cradles (see FIG. 1 in patent application US 2007/0120003.) The current teaching is that using both types of support in a specific geometric and spacing relationship to each other and in relationship to the location of the exit provides unique advantageous properties.

Some of the geometric relations that provide the device with its favorable properties are—a cradle of a radius of about the radius of the flange and a spindle between 80%-90% the radius of the arbor opening; the spindle's axis is located by the end plates such that the spools are resting on the cradle even when the spindle is inserted. When the lid is closed, the distance to the spindle from the lid is about 1.5 times the radius of the spool; and the angled portion of the lid is about 16-degrees. This angled portion of the lid can be thought of as an exit support surface. In some embodiments, the exit support surface may not be comprised in a lid but might be a portion of the nearest sidewall or otherwise supported.

The existing exit aperture radius is between 0.5" and 1". The cradle covers an arc of about 140-degrees centered on the bottom of the spools.

The cradle also acts as a fence or guard to prevent un-tensioned wire from dropping too far below the extent of the flange. In other devices, if a wire falls below a flange, there is a large possibility of the wire interfering with a neighboring spool or wire or otherwise causing other than smooth operations. An alternate cradle (not shown) comprised of a continuous mesh material, for example, may also be a very functional guard. In a rod-based cradle design with small diameter rods, the largest of the angular spacing between rods can be what determines a reliable guard and a "leaky" guard. FIGS. 3, 4 and 5 are based on an example design supporting spools of 12 gauge stranded wire. The angular spacing between adjacent rods is about 45 degrees. One of the operational events that can cause snagged wire in other designs is the release of the wire after being pulled. The wire's stiffness can cause it to pull back and result in the slack case seen in FIG. 6A. With a proper cradle seen in this figure as in the current embodiment, this is not a problem.

Figure 6B:
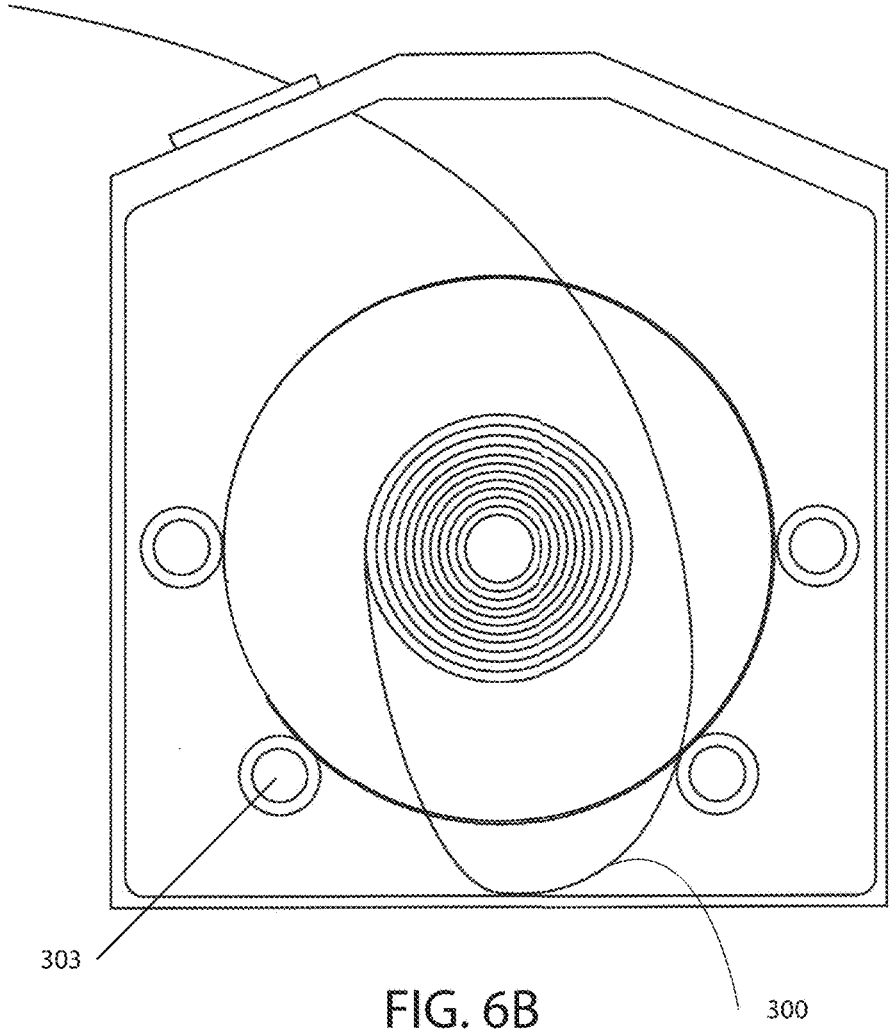
FIG. 6B shows a wire caddy with cradle spacing that is too large

FIG. 6B shows a case of supporting rods 303 being too far apart and allowing the snagged wire to be uncontrolled and result in a stray loop 300.

The requirements of the cradle as guard are determined by the stiffness and "springiness" of the wire. The less stiff the wire, the more closely the rods would need to be. In the present example the wire is 12 gauge stranded.

Exit Corner Configuration

Figure 6C:
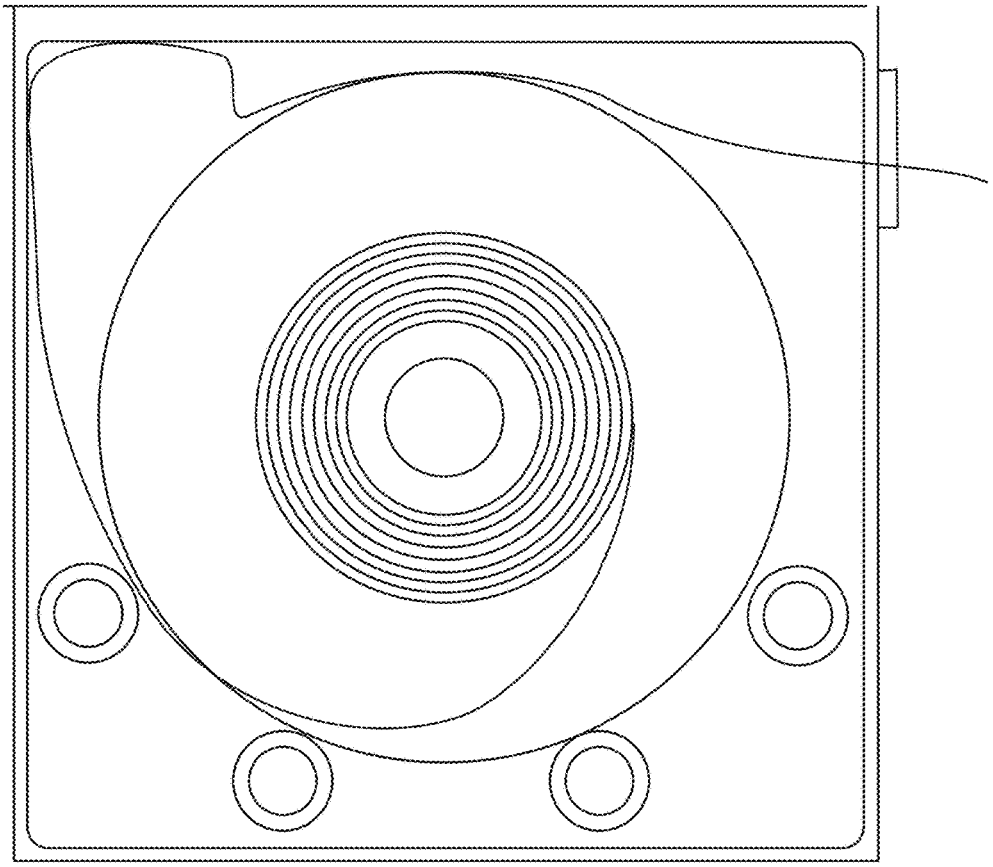
FIG. 6C shows a wire caddy with the problem of a loop of wire caught in a corner.

In many of the present figures, the exit opening is shown as a hole in an angled surface near one upper corner of the enclosure. A benefit of this "barn" shape of the corner with the direction of the exit at about 16-degrees is to reduce the chance of a stiff wire getting caught in the corner, as seen in FIG. 6C. If the exit were at the top of the sidewall, a stiff wire that was pulled and then released could easily get caught with a loop in the corner of the enclosure. If the opening is in a non-angled orientation, attempting to redirect the wire at near a 90-degree angle will generate significant friction and make pulling the wire difficult.

Broken Spools

Figure 7A:
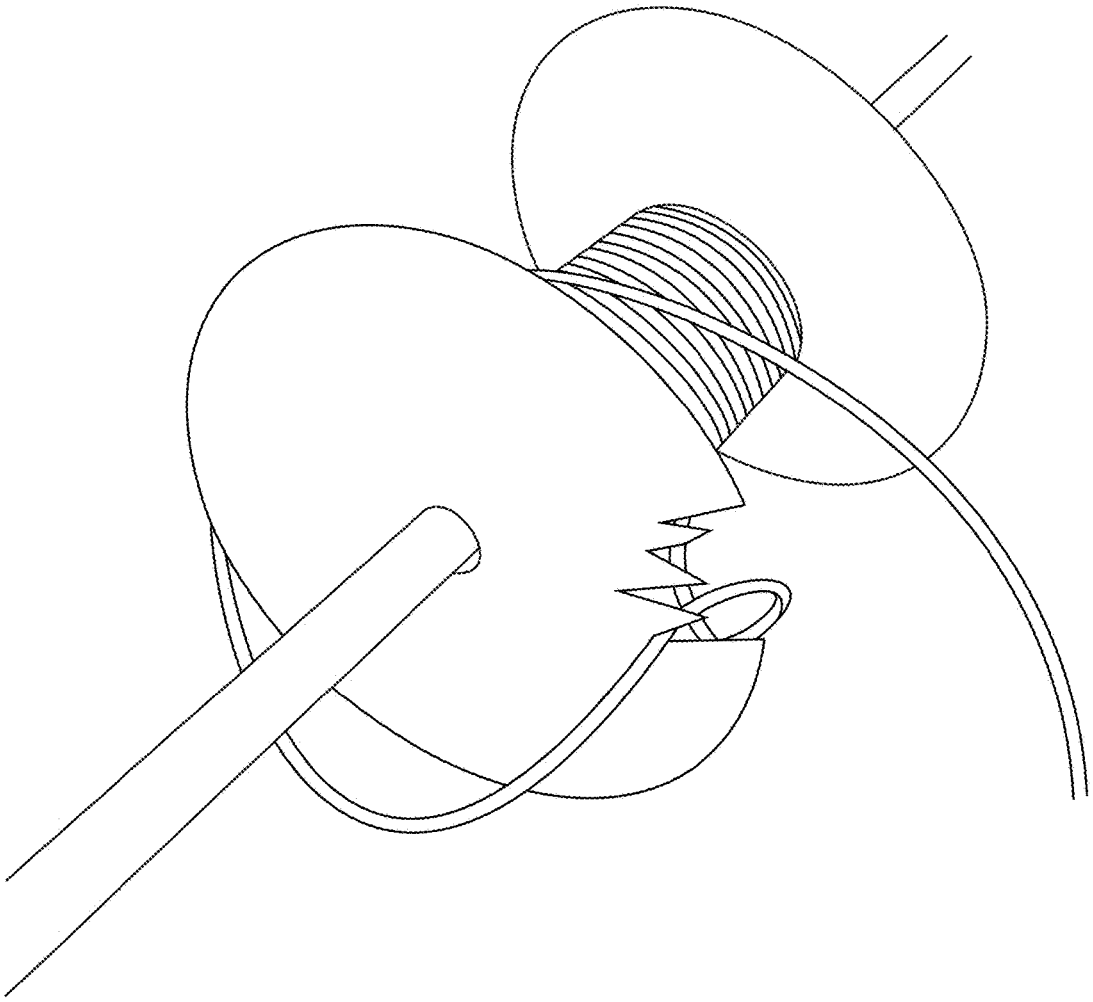
FIG. 7A shows an example broken spool.

The flanges of plastic spools are easily broken. Even though there may be significant wire on the spool, these are generally discarded because of the difficulty in using a broken spool as seen in FIG. 7A.

Figure 7B:
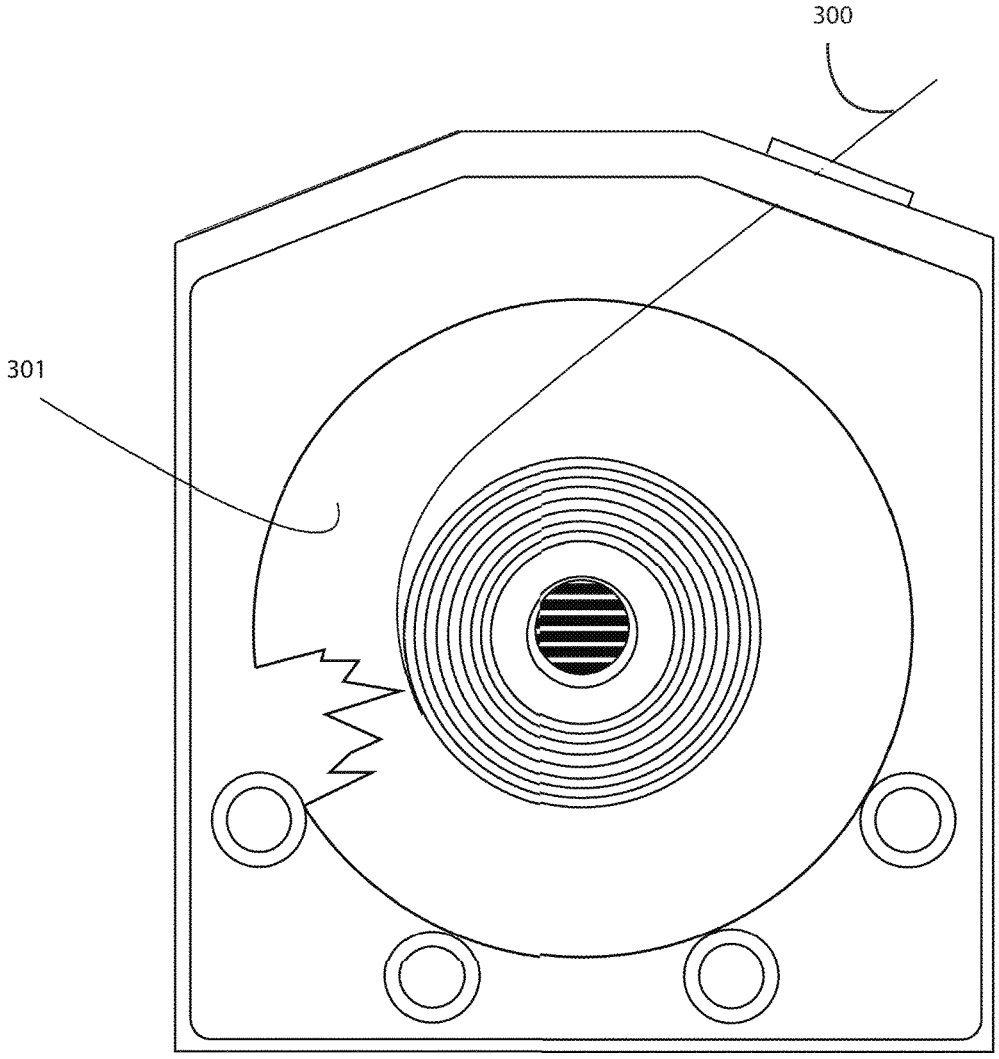
FIG. 7B shows a broken spool operational in the wire caddy of FIG. 3.
Figure 8:
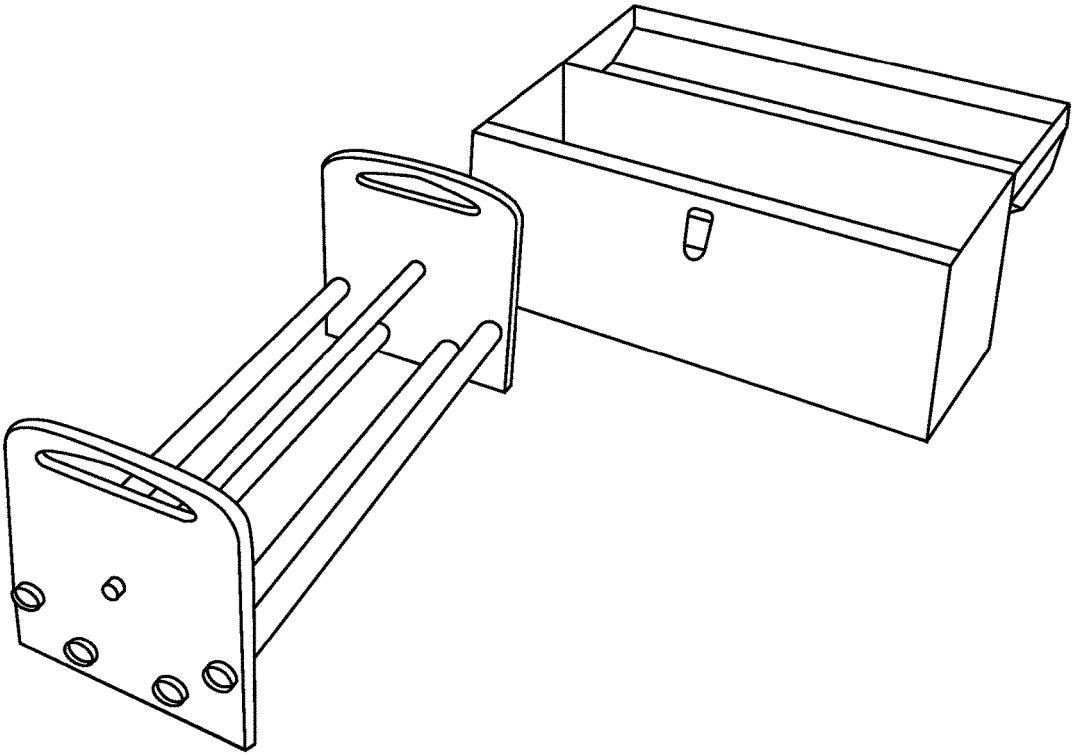
FIG. 8 is a photo of a prototype wire caddy, its components are shown to a consistent scale.

As seen in FIG. 7B, the described and pictured wire caddy embodiment can operate normally even with a broken spool 301.

It is claimed:

1. An apparatus for deployment of spooled wire of a predetermined stiffness from a spool of predetermined radial dimensions, including arbor and flange dimensions, the device comprising:

a) an elongated spindle with a cross-section sized to fit within a radius of a with an amount of play allowing for ready insertion and removal;

b) a spool support comprising:

two opposing, mechanically coupled, planar members with respective aligned openings of a size about that of the arbor radius, to support the spindle extending between the members;

an elongated cradle coupling the above mentioned planar members in parallel planes; the cradle located below and parallel to the path of an installed spindle where the cradle is arcuate in a direction perpendicular to the path of the spindle, the radius of that arc being substantially the same as the predetermined radius of the spool's flange such that the cradle supports a spool that is threaded on the spindle at rest; and where the axis of an installed spindle is directly above the center line of the cradle and the cradle covers about 140-degrees centered directly below the spindle; and a wire exit support surface (300), that, at least in operation, is mechanically constrained to the two opposing planar members; the exit support surface at about a 16-degree slant towards the spools, the surface having at least one wire exit opening; the opening being a distance above a spool, in use, such that the wire is at about a 60degree angle from the spool and the opening when the wire is under tension and the wire is coming from the far side of the spool's hub.

2. An apparatus for deployment of spooled wire of claim 1 further comprising a box that is sized to securely hold an assembly comprising the two planar members with attached cradle, installed spindle, and spools, where the assembly is readily insertable and removeable from the box.

3. An apparatus for deployment of spooled wire of claim 1 where the box has a hinged lid where the lid comprises the exit support surface.

* * * * *